US011575227B2

(12) United States Patent
Zhao et al.

(10) Patent No.: US 11,575,227 B2
(45) Date of Patent: Feb. 7, 2023

(54) ELECTRICAL CONNECTOR HAVING STABLY MOUNTED OUTER SHELL

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 30 days.

(21) Appl. No.: 17/202,896

(22) Filed: Mar. 16, 2021

(65) Prior Publication Data

US 2021/0288432 A1 Sep. 16, 2021

(30) Foreign Application Priority Data

Mar. 16, 2020 (CN) ..... 202010180867.5

(51) Int. Cl.

| | |
|---|---|
| ***H01R 13/506*** | (2006.01) |
| ***H01R 24/60*** | (2011.01) |
| ***H01R 43/24*** | (2006.01) |
| ***H01R 13/6581*** | (2011.01) |

(52) U.S. Cl.

CPC ..... *H01R 13/506* (2013.01); *H01R 24/60* (2013.01); *H01R 13/6581* (2013.01); *H01R 43/24* (2013.01)

(58) Field of Classification Search

None

See application file for complete search history.

(56) References Cited

U.S. PATENT DOCUMENTS

| | | | | |
|---|---|---|---|---|
| 9,882,316 | B2 | 1/2018 | Chen et al. | |
| 10,044,125 | B2 * | 8/2018 | Qiu | H01R 13/6271 |
| 10,116,098 | B2 * | 10/2018 | Zhao | H01R 13/6585 |
| 10,135,196 | B2 * | 11/2018 | Wen | H01R 13/6581 |
| 10,553,994 | B2 * | 2/2020 | Zhao | H01R 12/724 |
| 10,566,743 | B2 * | 2/2020 | Zhao | H01R 13/6594 |
| 2009/0253298 | A1 * | 10/2009 | Kameyama | H01R 12/724 439/607.41 |

(Continued)

FOREIGN PATENT DOCUMENTS

| | | | |
|---|---|---|---|
| CN | 2653741 | Y | 11/2004 |
| CN | 101740989 | A | 6/2010 |

(Continued)

*Primary Examiner* — Oscar C Jimenez

(74) *Attorney, Agent, or Firm* — Ming Chieh Chang

(57) ABSTRACT

An electrical connector includes: an insulative housing having a front tongue with two opposite surfaces; an upper and lower rows of contacts with contacting portions exposed to the two opposite surfaces of the tongue; and a primary shell enclosing the insulative housing to together with the tongue define a mating chamber, wherein the insulative housing includes a pair of side steps and a pair of side protrusions; and the primary shell includes a pair of side wings sitting on the pair of side steps, each side wing having a notch engaging a corresponding side protrusion.

15 Claims, 14 Drawing Sheets

(56) References Cited

U.S. PATENT DOCUMENTS

| | | | | |
|---|---|---|---|---|
| 2014/0187105 | A1* | 7/2014 | Zhao | H01R 12/707<br>29/874 |
| 2016/0352052 | A1* | 12/2016 | Yu | H01R 13/6585 |
| 2020/0076134 | A1* | 3/2020 | Su | H01R 13/5219 |

FOREIGN PATENT DOCUMENTS

| | | | |
|---|---|---|---|
| CN | 105305132 | A | 2/2016 |
| CN | 108173020 | A | 6/2018 |
| CN | 209822907 | U | 12/2019 |

* cited by examiner

ELECTRICAL CONNECTOR HAVING STABLY MOUNTED OUTER SHELL

BACKGROUND OF THE INVENTION

1. Field of the Invention

The present invention relates to an electrical connector comprising: an insulative housing having a front tongue with two opposite surfaces; an upper and lower rows of contacts with contacting portions exposed to the two opposite surfaces of the tongue; and a primary shell enclosing the insulative housing, wherein the insulative housing includes features for stably supporting the primary shell.

2. Description of Related Arts

China Patent No. 209822907 discloses an electrical connector including, among others, an insulative housing having a front tongue and an upper and lower rows of right-angle contacts having long vertical portions. These long vertical portion of the contracts are prone to deform if not properly supported during manufacturing. For such design having long contact vertical portion, an outer metallic shell enclosing the insulative housing to together with the front tongue define a mating chamber is also prone to deform if not properly supported.

SUMMARY OF THE INVENTION

An electrical connector comprises: an insulative housing having a front tongue with two opposite surfaces; an upper and lower rows of contacts with contacting portions exposed to the two opposite surfaces of the tongue; and a primary shell enclosing the insulative housing to together with the tongue define a mating chamber, wherein the insulative housing includes a pair of side steps and a pair of side protrusions, and the primary shell includes a pair of side wings sitting on the pair of side steps, each side wing having a notch engaging a corresponding side protrusion.

DETAILED DESCRIPTION OF THE PREFERRED EMBODIMENT

Figure 1:
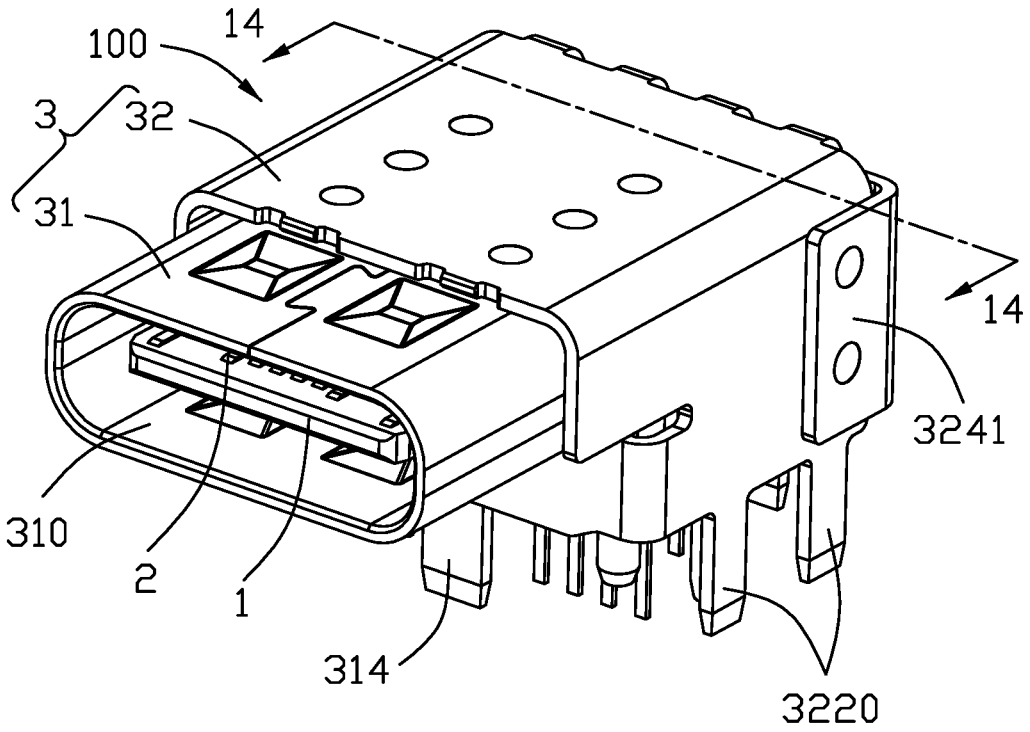
FIG. 1 is a perspective view of an electrical connector in accordance with the present invention.
Figure 2:
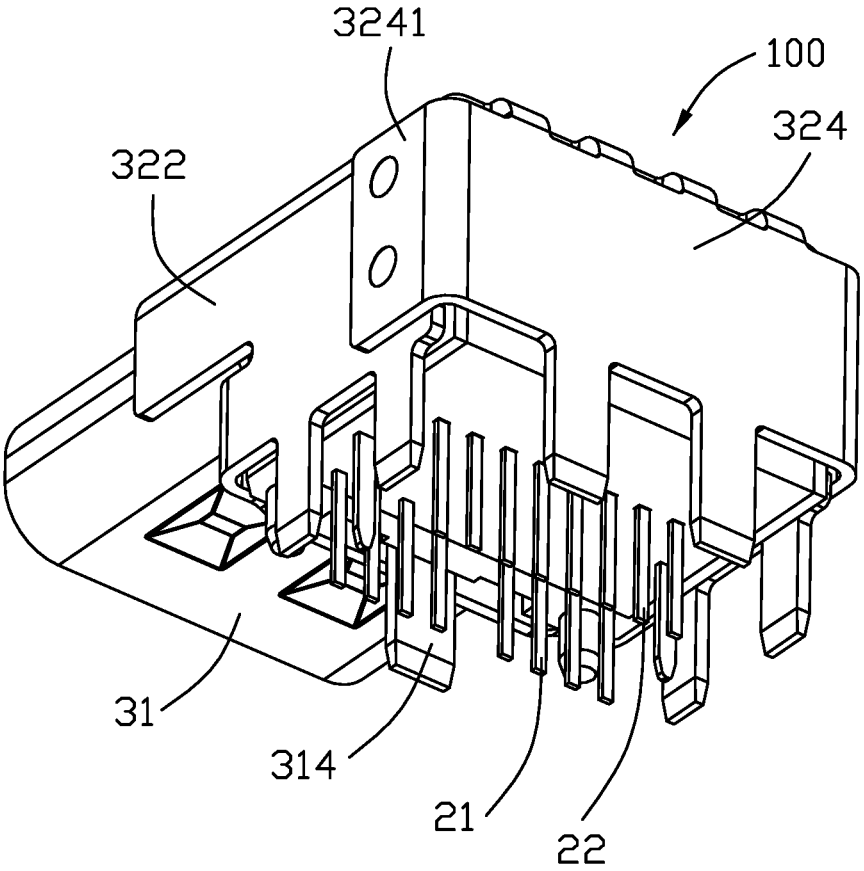
FIG. 2 is a perspective view of the electrical connector from another perspective.
Figure 3:
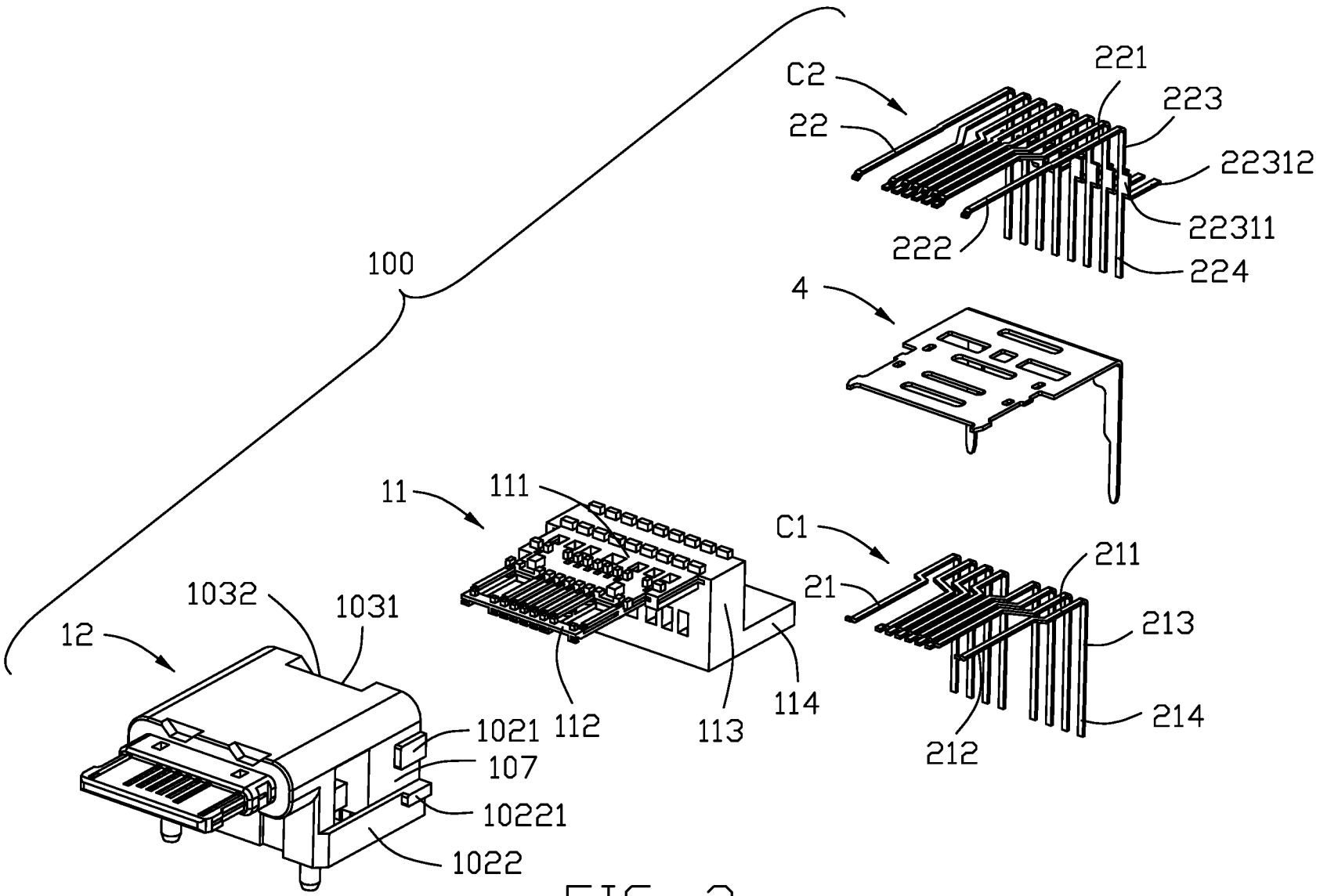
FIG. 3 is an exploded view of a contact module of the electrical connector in FIG. 1.
Figure 4:
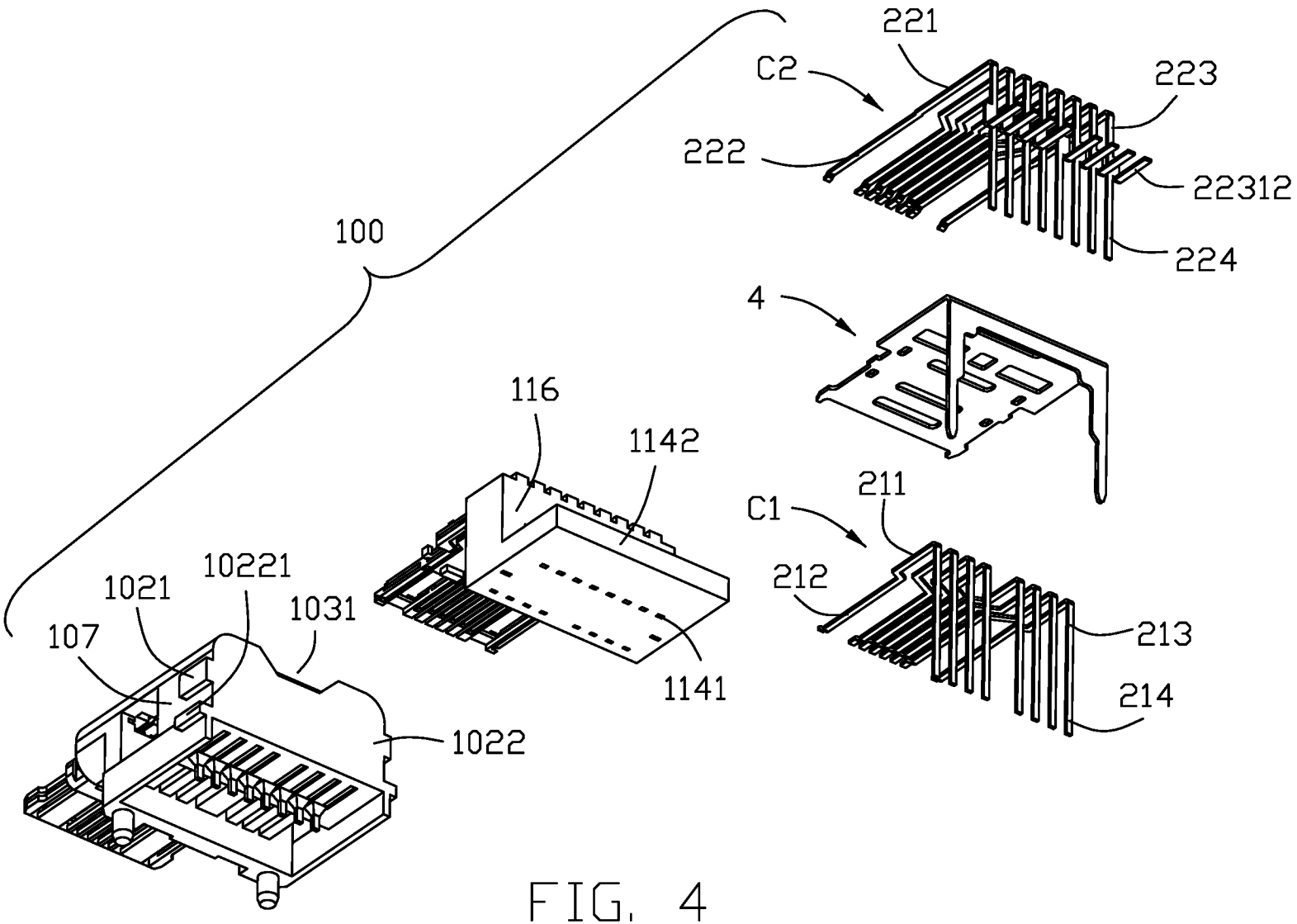
FIG. 4 is an exploded view of the contact module in FIG. 3 from another perspective.
Figure 5:
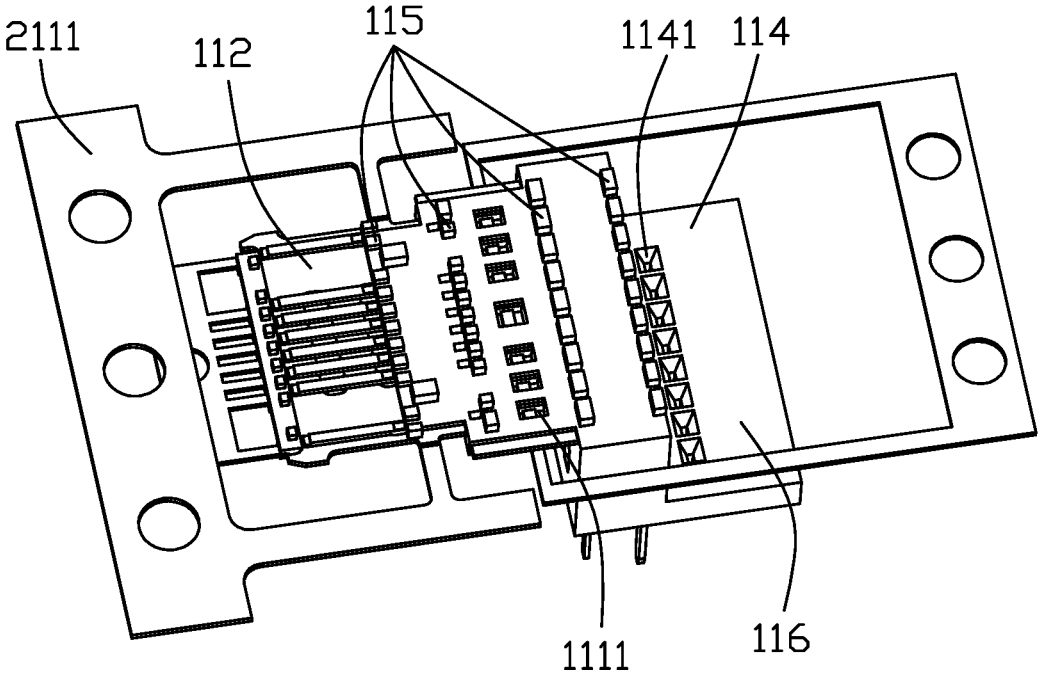
FIG. 5 shows an intermediate state of manufacturing the contact module.
Figure 6:
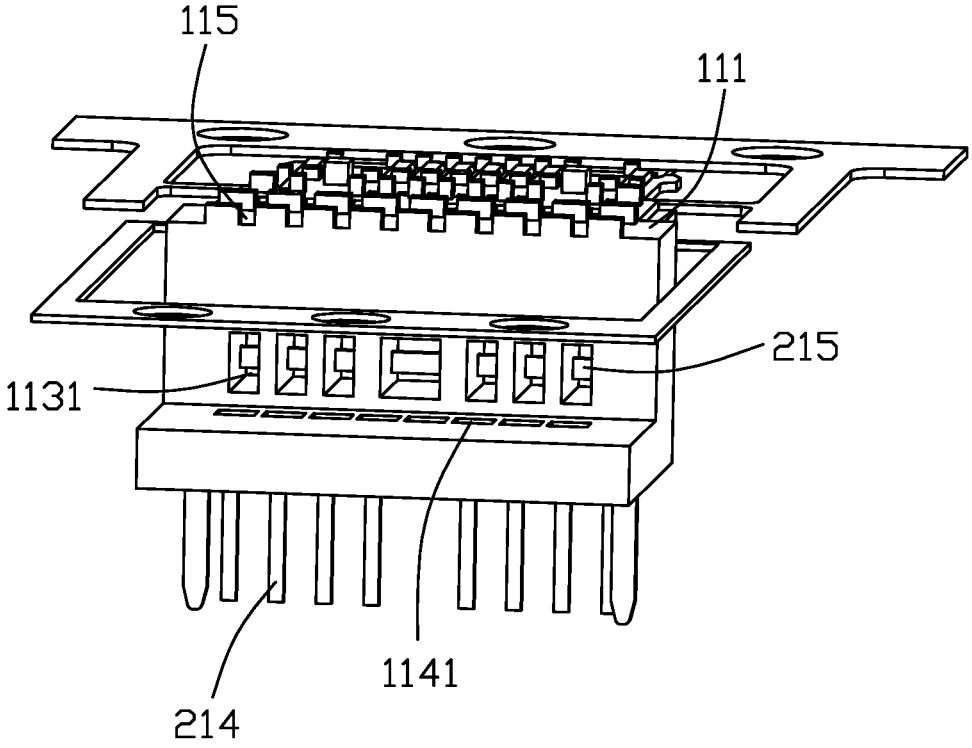
FIG. 6 shows the state of FIG. 5 from another perspective.
Figure 7:
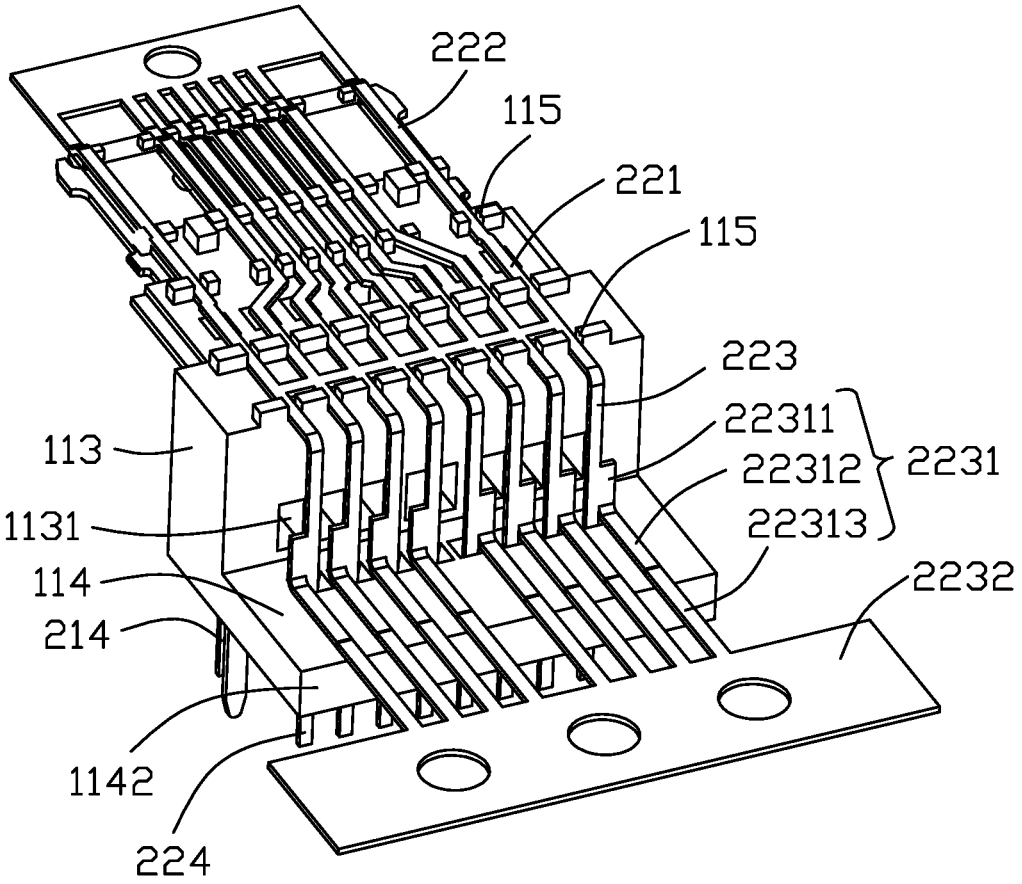
FIG. 7 shows another intermediate state of manufacturing the contact module.
Figure 8:
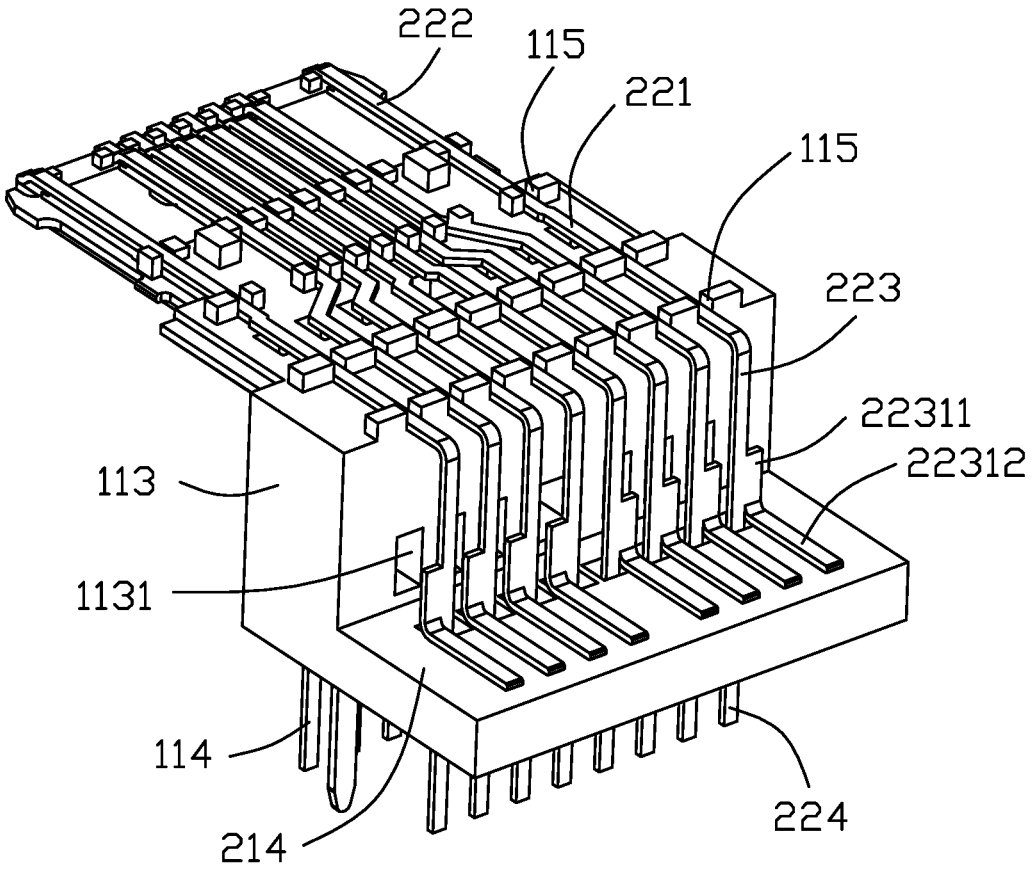
FIG. 8 shows the state of FIG. 7 after removing a carrier strip.
Figure 9:
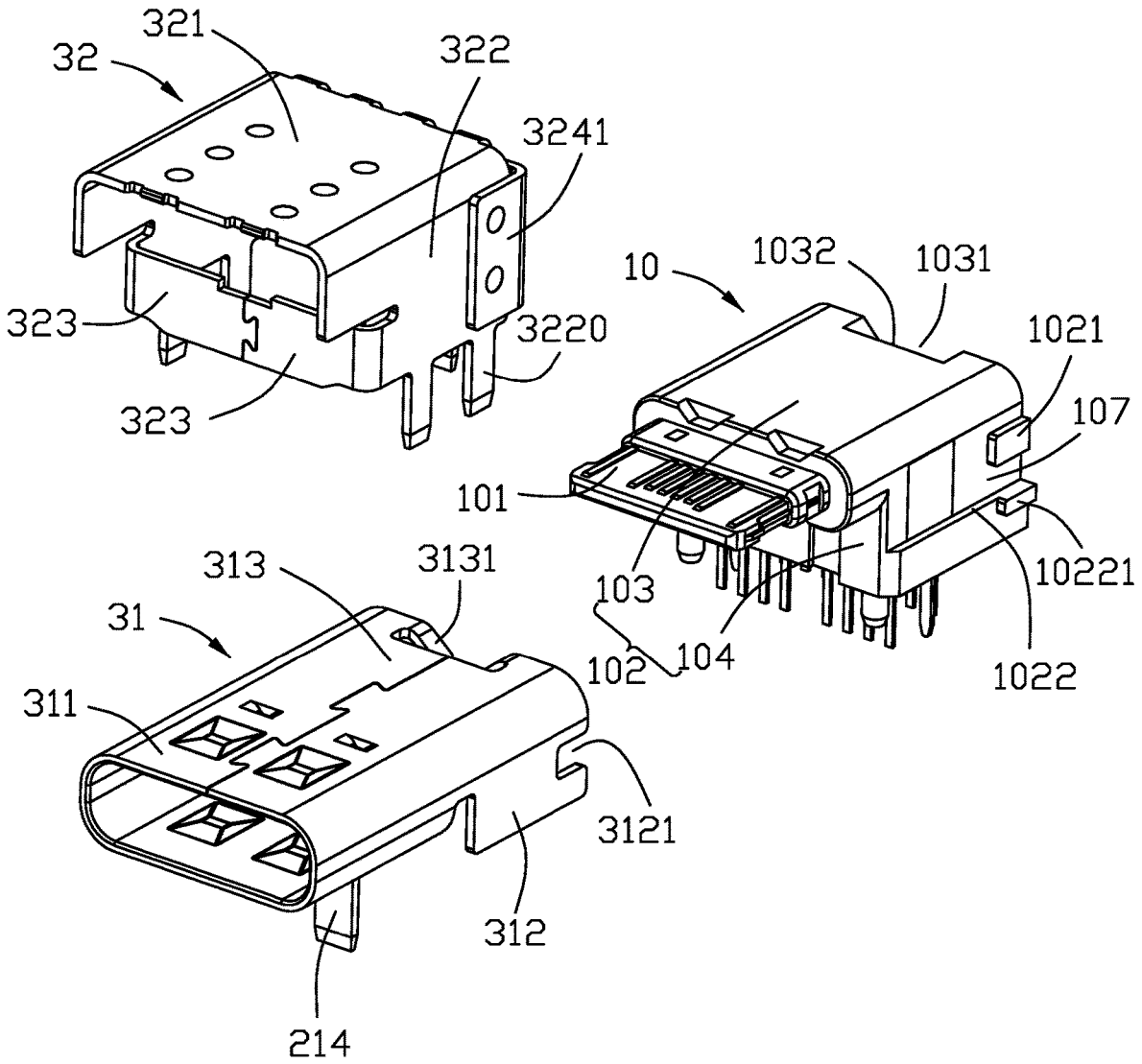
FIG. 9 is an exploded view of the electrical connector in FIG. 1.
Figure 10:
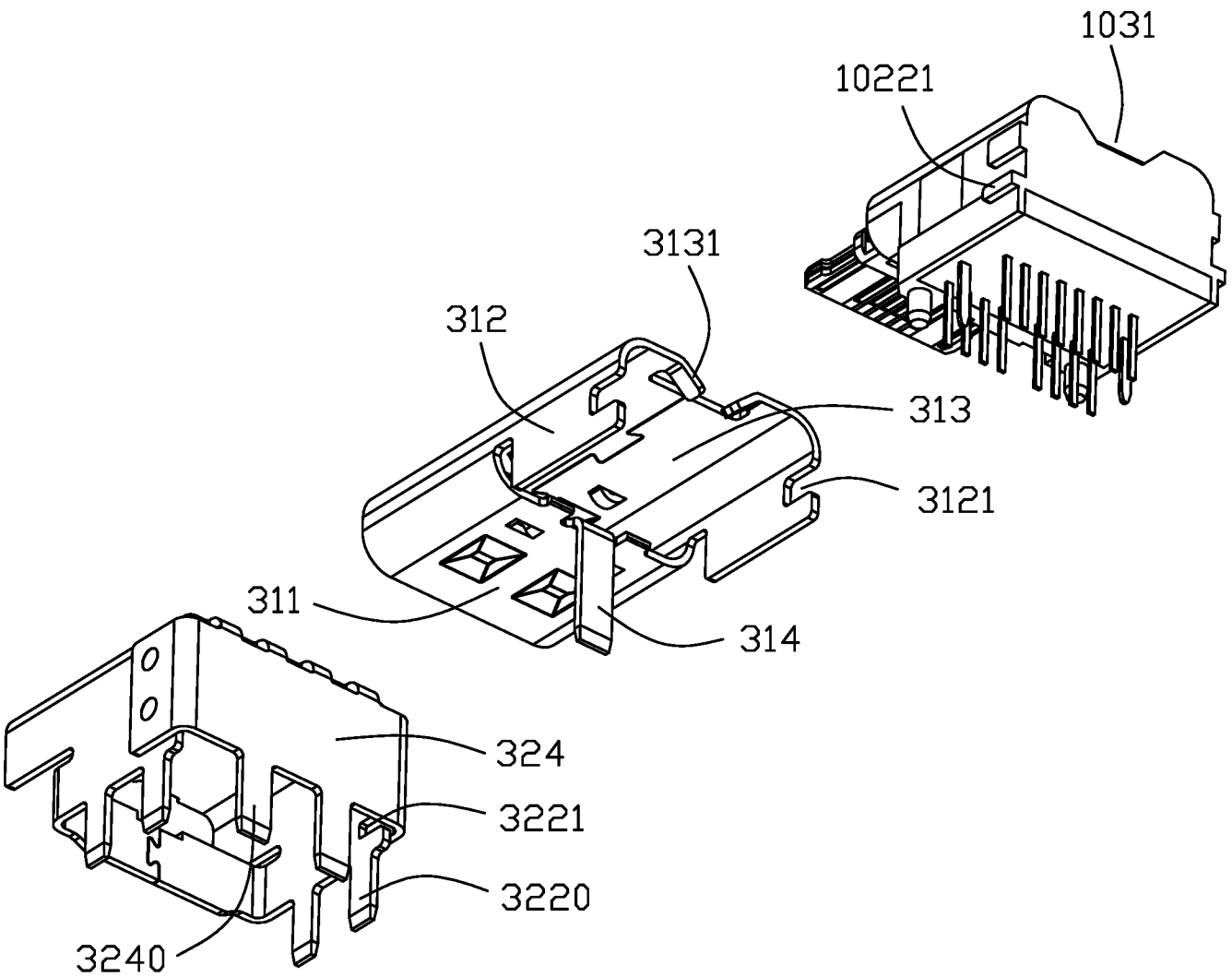
FIG. 10 is an exploded view of the electrical connector in FIG. 2.

Referring to FIGS. 1-12, an electrical connector 100 comprises an insulative housing 1 consisting of a first insulator 11 and a second insulator 12, and a first and second rows C1 and C2 of contacts 21 and 22 secured in the insulative housing 1 to together form a contact module 10. The electrical connector 100 may further comprise a middle shielding plate 4 and a shielding shell 3 consisting of a primary shell 31 and an auxiliary shell 32.

The first insulator 11 is insert molded with the first row of contacts 21 and the shielding shell 3 if present and has a base 111, a tongue 112, an upright portion 113, and a mounting portion 114. The first contact 21 has a securing portion 211, a contacting portion 212, an upright portion 213, and a tail 214. During manufacturing, the upright portions 213 of the first contacts 21 are connected by bridges 215. The upright portion 113 of the first insulator 11 has corresponding holes 1131 for severing the bridges 215, preferably after the first insulator 11 is insert molded with the first row of contacts 21. The provision of bridges 215 help stabilize the long and slender upright portions 213 of the first contacts 21.

The second row of contacts 22 are mounted to the first insulator 11 along a top-to-down direction and then the second insulator 12 is molded to the sub-assembly. The second contact 22 has a securing portion 221, a contacting portion 222, an upright portion 223, and a tail 224. At least one of the base 111 and the tongue 112 has plural grooves 115, the mounting portion 114 has plural holes 1141, and a receiving space 116 is defined between an upper surface of the mounting portion 114 and a rear surface of the upright portion 113. When the second row of contacts 22 are mounted to the first insulator 11, at least corresponding ones of the securing portions 221 and the contacting portions 222 are mounted to the grooves 115, the upright portions 223 are accommodated in the receiving space 116, and the tails 224 extend downwardly through the holes 1141. In view of the relatively long upright portion 223 and tail 224 as a whole, in order to ensure coplanarity of the tails 224 and stability of the upright portion 223 during a molding process, the contact 22 further has a bearing strip 2231 beside the upright portion 223. The bearing strip 2231 bears downward against the upper surface of the mounting portion 114 of the first insulator 11 during manufacturing and are connected by a carrier strip 2232 to be severed later. The bearing strip 2231 includes a connecting part 22311 coplanar with the upright portion 223, a bent part 22312 for bearing against the upper surface of the mounting portion 114, and a rear severing part 22313 connected to the carrier strip 2232. Before molding the second insulator 12, the carrier strip 2232 and the severing parts 22313 are removed; after molding the second insulator 12, the contacting portions 212 and 222 of the upper and lower rows of contacts 22 and 21 are exposed while the connecting parts 22311 and the bent parts 22312 of the upper row of contacts 22 are embedded for esthetic purpose.

In addition, the securing portions 211 of the first lower contacts 21 are connected by plural bridges 2111 to be severed through holes 1111 of the insulator base 111 preferably right after molding the first insulator 11 with the contacts 21.

The second insulator 12 over-molds the tongue 112 of the first insulator 11 to form a tongue 101 of the insulative housing 1; the second insulator 12 over-molds the base 111, the upright portion 113, and the mounting portion 114 of the first insulator 11 to form a base 102 of the insulative housing 1. The base 102 has a pair of side channels 107, a pair of side protrusions 1021 in the channels 107, and a pair of side steps 1022 below the pair of side protrusions 1021. The primary shell 31 has a tubular portion 311 which together with the tongue 101 defines a mating chamber 310, a pair of side wings 312, a top wall/plate 313 between the pair of wings 312, and a soldering/mounting leg 314 extending downward from a rear edge of the tubular portion 311. Each side wing 312 has a notch 3121 for engaging the side protrusion 1021. The base 102 is constructed to have a base portion 103 and an upright portion 104 below the base portion 103. The side protrusions 1021 and the side steps 1022 protrude from the base portion 103. The tubular portion 311 is secured to the base portion 103. In addition, the base portion 103 has a groove 1031 with a limiting face 1032 and the primary shell 31 has a pair of fingers 3131. The side protrusions 1021 engage the notches 3121 and the upright portion 104 abuts the tubular portion 311 so the insulative housing 1 is prevented from further moving forward. The fingers 3131 abut the face 1032 so the insulative housing 1 is prevented from further moving backward. The side steps 1022 support the wings 312 so that the primary shell 31 is stably supported to prevent mis-alignment of the shell relative to the tongue 101.

The secondary shell 32 includes a top wall 321 welded to the tubular portion 311 and the top wall 313 of the primary shell 31, a pair of side walls 322, a pair of front guards or stoppers 323, and a rear wall 324. The guards may be connected by a dove-tailed structure and may be spot welded to the leg 314. The rear wall 324 has a pair of fixing pieces 3241 secured to the side walls 322. The base 102 of the insulative housing 1 has a pair of ribs 10221 protruding from the side steps 1022. The secondary shell 32 has a pair of notches 3221 engaging the pair of ribs 10221. Assembled insulative housing 1 and primary shell 31 are mounted forwardly to the secondary shell 32 until the upright portion 104 and the leg 314 abut the front guards 323 where the ribs 10221 engage the notches 3221. In addition, the side wall 322 has soldering/mounting legs 3220 and the rear wall 324 has soldering/mounting legs 3240. Notably, the stoppers 323, the side walls 322 and the rear wall 324 of the secondary shell 32 commonly form a receiving space (not labeled) to receive the base 102 of the housing 1, and the mounting legs 314, 3220, 3240 commonly surround the area below the receiving space.

Figure 11:
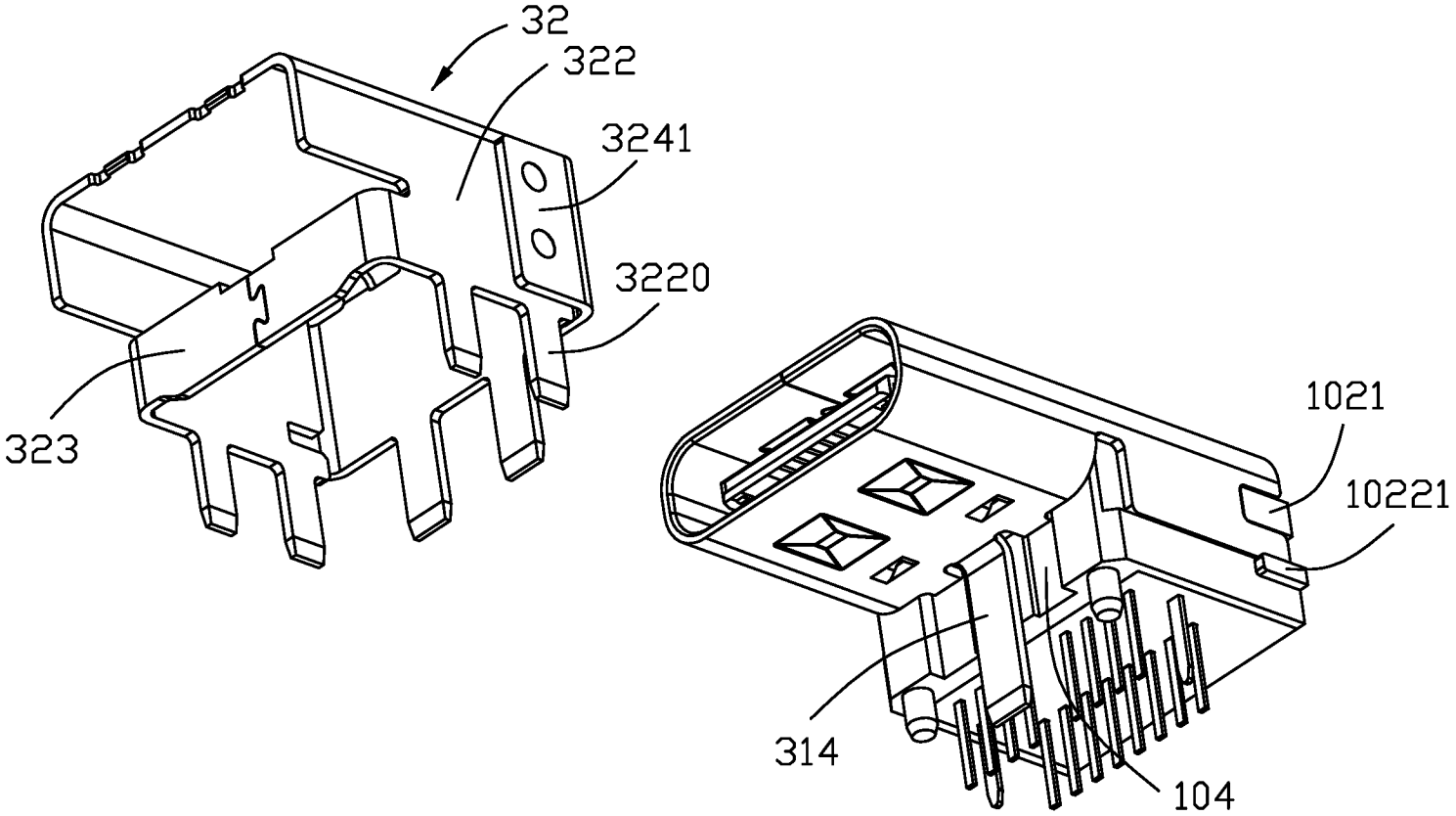
FIG. 11 is a partially assembled view of the electrical connector in FIG. 10 from another perspective.
Figure 12:
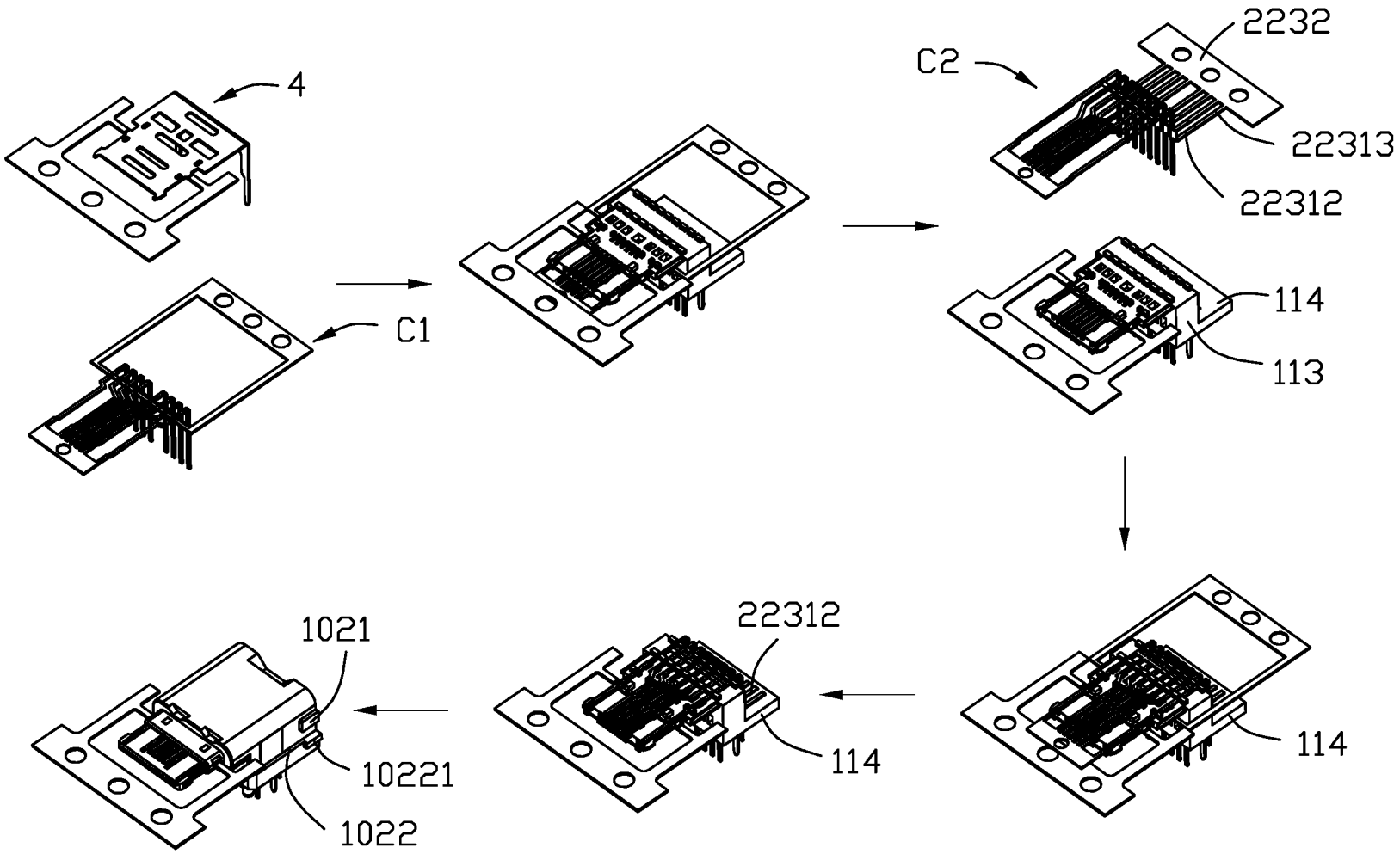
FIG. 12 is a schematic flow diagram showing steps of manufacturing the electrical connector.
Figure 13:
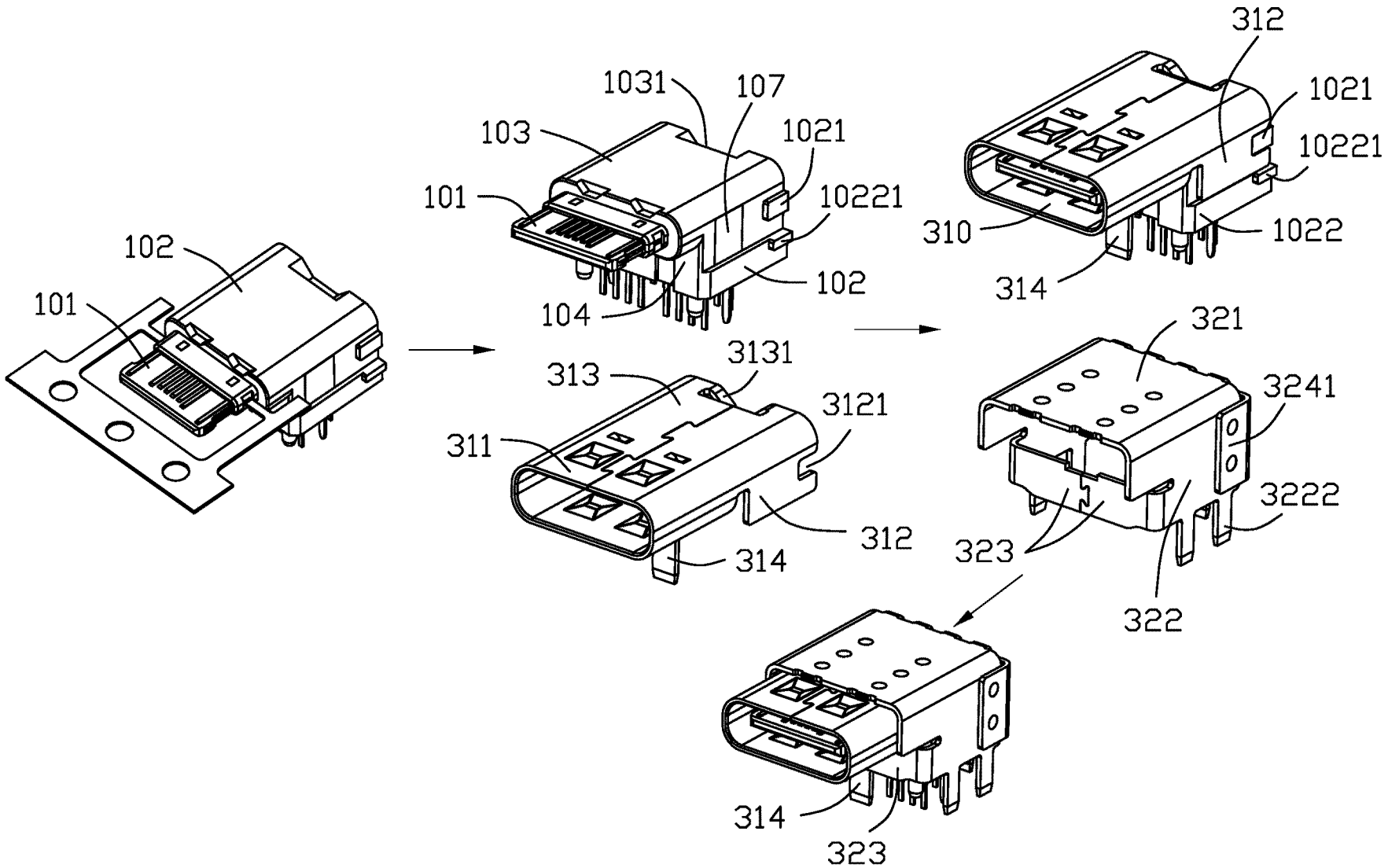
FIG. 13 continues FIG. 11.
Figure 14:
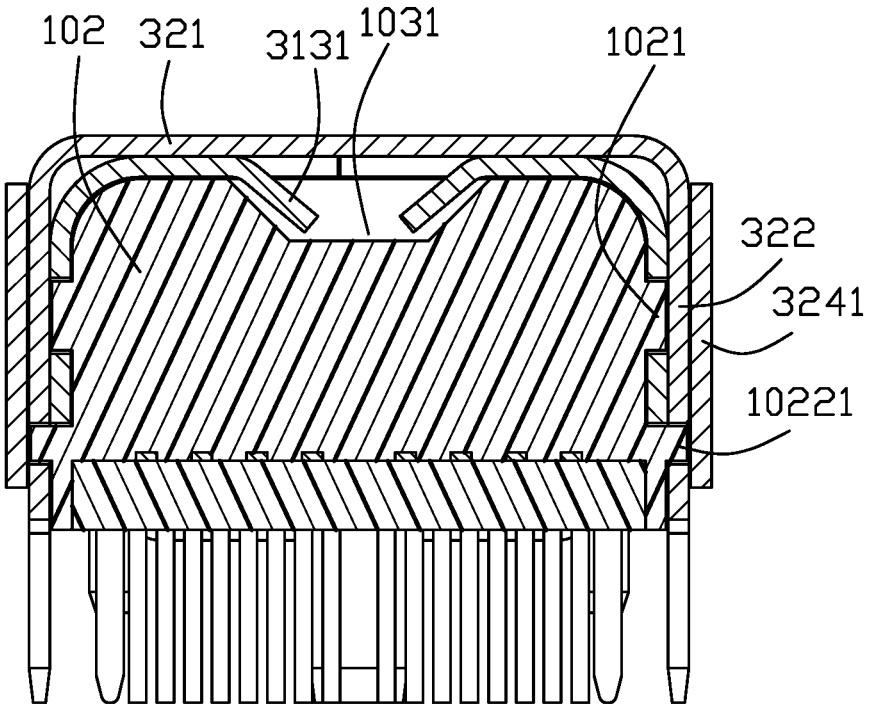
FIG. 14 is a cross-sectional view of the electrical connector taken along line A-A in FIG. 1.

A method of making the electrical connector 100 will be described by reference to FIGS. 11 and 12.

Step 1: A contact carrier carrying the first lower row C1 of contacts and another carrier carrying the shielding plate 4 are prepared.

Step 2: The first insulator is molded to the lower row of contacts to have a base, a lower upright portion, and a rear mounting portion.

Step 3: The upper row C2 of contacts are prepared.

Step 4: The upper row C2 of contacts are mounted to the first insulator by inserting tails thereof through the mounting portion 114 of the first insulator until the bearing portions thereof bear against the mounting portion 114.

Step 5: The carrier strip 2232 and the severing parts 22313 are removed from the bearing portions of the upper row of contacts.

Step 6: The second insulator is molded with the upper and lower rows of contacts as well as the first insulator to expose the upper and lower contacting portions of the upper and lower rows of contacts while embedding the bearing portions of the upper row of contacts.

Step 7: The primary shell is mounted to the contact module.

Step 8: The secondary shell is mounted to the primary shell.

What is claimed is:

1. An electrical connector comprising:

an insulative housing having a front tongue with two opposite surfaces;

an upper and lower rows of contacts with contacting portions exposed to the two opposite surfaces of the tongue;

a primary shell enclosing the insulative housing to together with the tongue define a mating chamber; and a secondary shell enclosing the primary shell; wherein the insulative housing includes a pair of side steps and a pair of side protrusions;

the primary shell includes a pair of side wings sitting on the pair of side steps, each side wing having a notch engaging a corresponding side protrusion; and the insulative housing has a pair of ribs protruding from the side steps and the secondary shell has a pair of notches engaging the pair of ribs.

2. An electrical connector comprising:

an insulative housing having a base and a front tongue extending forwardly therefrom with two opposite surfaces on the front tongue;

an upper and lower rows of contacts with contacting portions exposed to the two opposite surfaces of the tongue;

a primary shell including a tubular portion together with the tongue to define a mating chamber, a pair of side wings, and a top plate located between the pair of wings to cooperate with the pair of wings to receive the base of the housing; and a secondary shell including a top wall fixed to both the tubular portion and the top plate, a pair of side walls unitarily extending downwardly from two lateral sides of the top wall, respectively, a front stopper unitarily extending from at least a lower portion of the corresponding side wall, and a rear wall unitarily downwardly from a rear edge of the top wall; wherein the pair of side walls, the rear wall and the front stopper commonly form a receiving space to receive the base of the housing therein; and the primary shell further includes a mounting leg extending downwardly from a rear edge of the tubular portion and into the receiving space behind the front stopper.

3. The electrical connector as claimed in claim 2, wherein the pair of side walls and the rear wall of the secondary shell include corresponding mounting legs, respectively, to cooperate with the mounting leg of the primary shell to surround an area below the receiving space.

4. The electrical connector as claimed in claim 2, wherein the mounting leg rearwardly abuts against the base.

5. The electrical connector as claimed in claim 2, wherein each side wing is seated upon a step formed on the base.

6. The electrical connector as claimed in claim 5, wherein each side wing forms a notch to receive a corresponding protrusion formed on the base.

7. The electrical connector as claimed in claim 2, wherein the side walls are longer than the side wings in a vertical direction.

8. The electrical connector as claimed in claim 2, wherein each side wall includes a mounting leg while each side wing has no mounting leg.

9. An electrical connector comprising:

an insulative housing having a base and a front tongue extending forwardly therefrom with two opposite surfaces on the front tongue;

an upper and lower rows of contacts with contacting portions exposed to the two opposite surfaces of the tongue;

a primary shell including a tubular portion together with the tongue to define a mating chamber, a pair of side wings, and a top plate located between the pair of wings to cooperate with the pair of wings to receive the base of the housing; and a secondary shell including a top wall fixed to both the tubular portion and the top plate, a pair of side walls unitarily extending downwardly from two lateral sides of the top wall, respectively, a front stopper unitarily extending from at least a lower portion of the corresponding side wall, and a rear wall unitarily downwardly from a rear edge of the top wall; wherein the pair of side walls, the rear wall, and the front stopper together form a receiving space to receive the base of the housing therein; and each side wall includes a mounting leg while each side wing has no mounting leg.

10. The electrical connector as claimed in claim 9, wherein the primary shell further includes a mounting leg extending downwardly from a rear edge of the tubular portion and into the receiving space behind the front stopper.

11. The electrical connector as claimed in claim 10, wherein the pair of side walls and the rear wall of the secondary shell include corresponding mounting legs, respectively, to cooperate with the mounting leg of the primary shell to surround an area below the receiving space.

12. The electrical connector as claimed in claim 10, wherein the mounting leg rearwardly abuts against the base.

13. The electrical connector as claimed in claim 9, wherein each side wing is seated upon a step formed on the base.

14. The electrical connector as claimed in claim 13, wherein each side wing forms a notch to receive a corresponding protrusion formed on the base.

15. The electrical connector as claimed in claim 9, wherein the side walls are longer than the side wings in a vertical direction.

* * * * *